US007312781B2

(12) United States Patent
Jen et al.

(10) Patent No.: US 7,312,781 B2
(45) Date of Patent: Dec. 25, 2007

(54) METHOD FOR DYNAMICALLY MODULATING DRIVING CURRENT OF BACKLIGHT MODULE

(75) Inventors: Tean Sen Jen, Taoyuan County (TW); Wen Chi Lin, Hsinchu County (TW)

(73) Assignee: Hannstar Display Corporation, Taipei (TW)

( * ) Notice: Subject to any disclaimer, the term of this patent is extended or adjusted under 35 U.S.C. 154(b) by 560 days.

(21) Appl. No.: 10/790,825

(22) Filed: Mar. 3, 2004

(65) Prior Publication Data

US 2005/0093815 A1 May 5, 2005

(30) Foreign Application Priority Data

Nov. 5, 2003 (TW) ..... 92131136 A

(51) Int. Cl.
*G09G 3/36* (2006.01)

(52) U.S. Cl. ..... 345/102; 345/211; 345/212; 345/213; 345/204; 345/690

(58) Field of Classification Search ..... 345/102, 345/87, 89, 211–214, 690, 204
See application file for complete search history.

(56) References Cited

U.S. PATENT DOCUMENTS

| | | | | |
|---|---|---|---|---|
| 6,839,048 | B2 * | 1/2005 | Park | 345/102 |
| 6,850,214 | B2 * | 2/2005 | Nishitani et al. | 345/87 |
| 2005/0057484 | A1 * | 3/2005 | Diefenbaugh et al. | 345/102 |
| 2005/0104838 | A1 * | 5/2005 | Sasaki | 345/102 |

* cited by examiner

*Primary Examiner*—Richard Hjerpe
*Assistant Examiner*—Jennifer T Nguyen
(74) *Attorney, Agent, or Firm*—Volentine & Whitt, PLLC

(57) ABSTRACT

According to the brightness distribution of a previous frame, the driving current of the backlight module dynamically varies. When the concentration of the brightness distribution is toward high brightness, the backlight module increases its luminous intensity. On the contrary, when the concentration of the brightness distribution is toward low brightness, the backlight module decreases its luminous intensity. We can set the luminous modulation period of the backlight module to be synchronized with a vertical scanning period or several vertical scanning periods.

10 Claims, 3 Drawing Sheets

METHOD FOR DYNAMICALLY MODULATING DRIVING CURRENT OF BACKLIGHT MODULE

BACKGROUND OF THE INVENTION

1. Field of the Invention

The present invention relates to a method for dynamically modulating the driving current of a backlight module, and more specifically to a method for tuning the driving current of a backlight module according to the integral gradation of a frame.

2. Description of the Related Art

The display generated by a conventional cathode ray tube (CRT) is an impulse-type image that enables the viewer to see a high contrast frame. In contrast, when a liquid crystal display (LCD) shows a frame, its backlight source maintains a constant brightness, while the varying orientation of the liquid crystal molecules allows the rays emitted from the backlight source to go through in order to create many gradations or gray levels. Generally, the display generated by a CRT has a color contrast superior to the one generated by an LCD, and the contrast ratios (CR) from the measurement of these frames can further support the fact. The contrast ratio is expressed as follows:

$$CR = \frac{L_W}{L_B};$$

wherein $L_W$ is the measured brightness of a frame when a pixel displays a true white, and $L_B$ is the measured brightness of a frame when a pixel displays a true black.

The black display of a CRT is a true black image; hence its contrast ratio is higher than an LCD's. On the other hand, the display generated by an LCD is a hold-type image. The black display of an LCD is not a true black image due to the constant luminance of the backlight source, hence the image of an LCD is not sufficiently sharp and bright in its color contrast.

FIG. 1 is a functional block diagram of a conventional liquid crystal display. A timing controller 13 generates timing signals that trigger a scanning driver 12 and a data driver 17 to be active to send the LCD panel 11 various driving signals. Furthermore, a backlight module 14 is placed behind the LCD panel 11 as a light source to highlight the frame displayed by the LCD panel 11 for the viewer to watch. Presently most backlight modules 14 employ a cold cathode fluorescent lamp (CCFL) as a light source, hence a DC/AC converter 15 is necessary to supply AC power to the CCFL.

Regarding conventional LCDs, the CCFL is mostly powered by a constant current source; hence a backlight source always steadily luminesces behind the LCD even though all of the pixels of a frame display black. The steady existence of the backlight source results in a lesser contrast ratio for the LCD. Therefore, in order to improve the contrast ratio of the LCD, several methods are put forth for effectively shading the rays from the backlight source during a true black frame as far as possible. However, these methods cannot effectively shade the emitted rays completely so the contrast ratio is still inferior.

In summary, LCDs with a superior contrast ratio are needed for the display market to provide viewers with a better image quality.

SUMMARY OF THE INVENTION

The objective of the present invention is to provide an LCD with a high contrast ratio having a backlight module capable of modulating its luminous intensity according to the even gradation of a previous frame.

In order to achieve the objective, the present invention discloses a method for dynamically modulating the driving current of a backlight module. According to the brightness distribution of a previous frame, the driving current of the backlight module varies dynamically. When the concentration of the brightness distribution is toward high brightness, the backlight module increases its luminous intensity. On the contrary, when the concentration of the brightness distribution is toward low brightness, the backlight module decreases its luminous intensity. We can set the luminous modulation period of the backlight module to be synchronized with a vertical scanning period or several vertical scanning periods.

BRIEF DESCRIPTION OF THE DRAWINGS

The invention will be described according to the appended drawings in which.

PREFERRED EMBODIMENT OF THE PRESENT INVENTION

Figure 1:
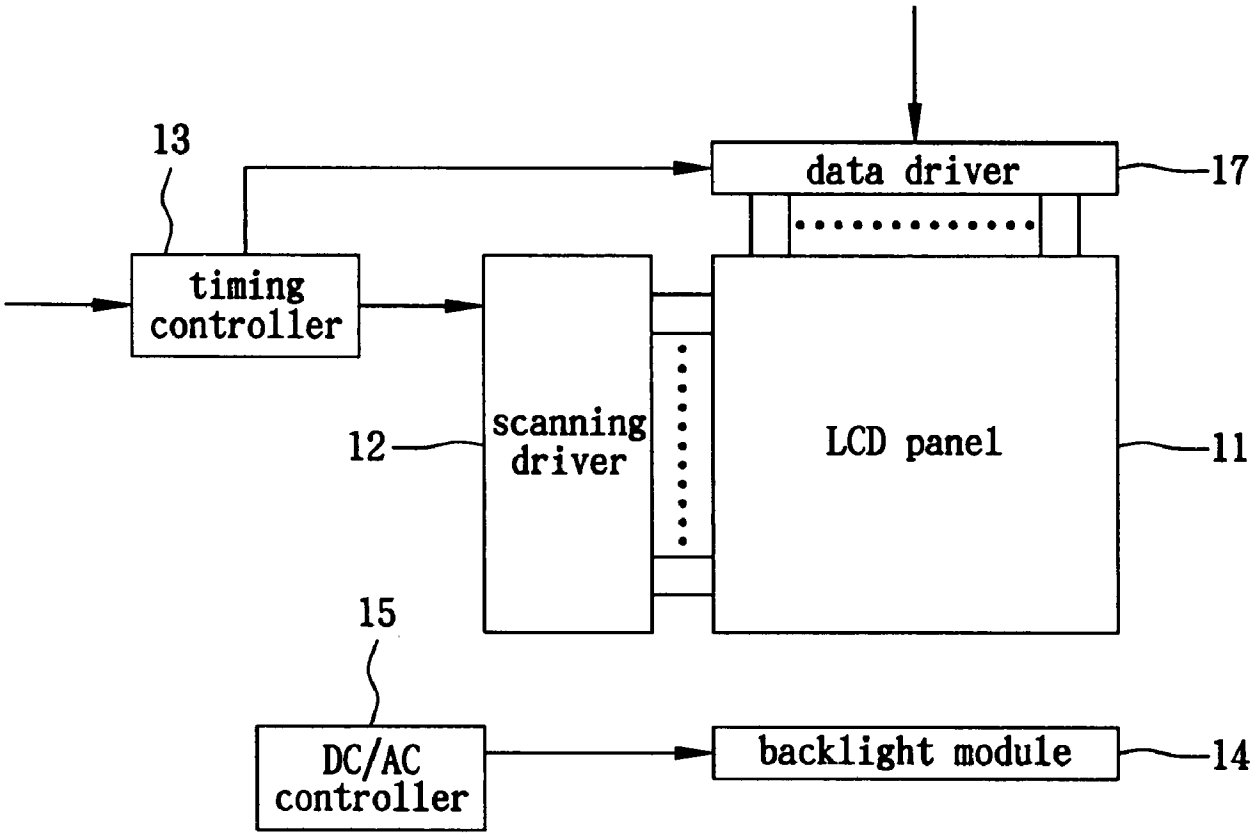
FIG. 1 (Background Art)
FIG. 1 is a functional block diagram of a conventional liquid crystal display.
Figure 2:
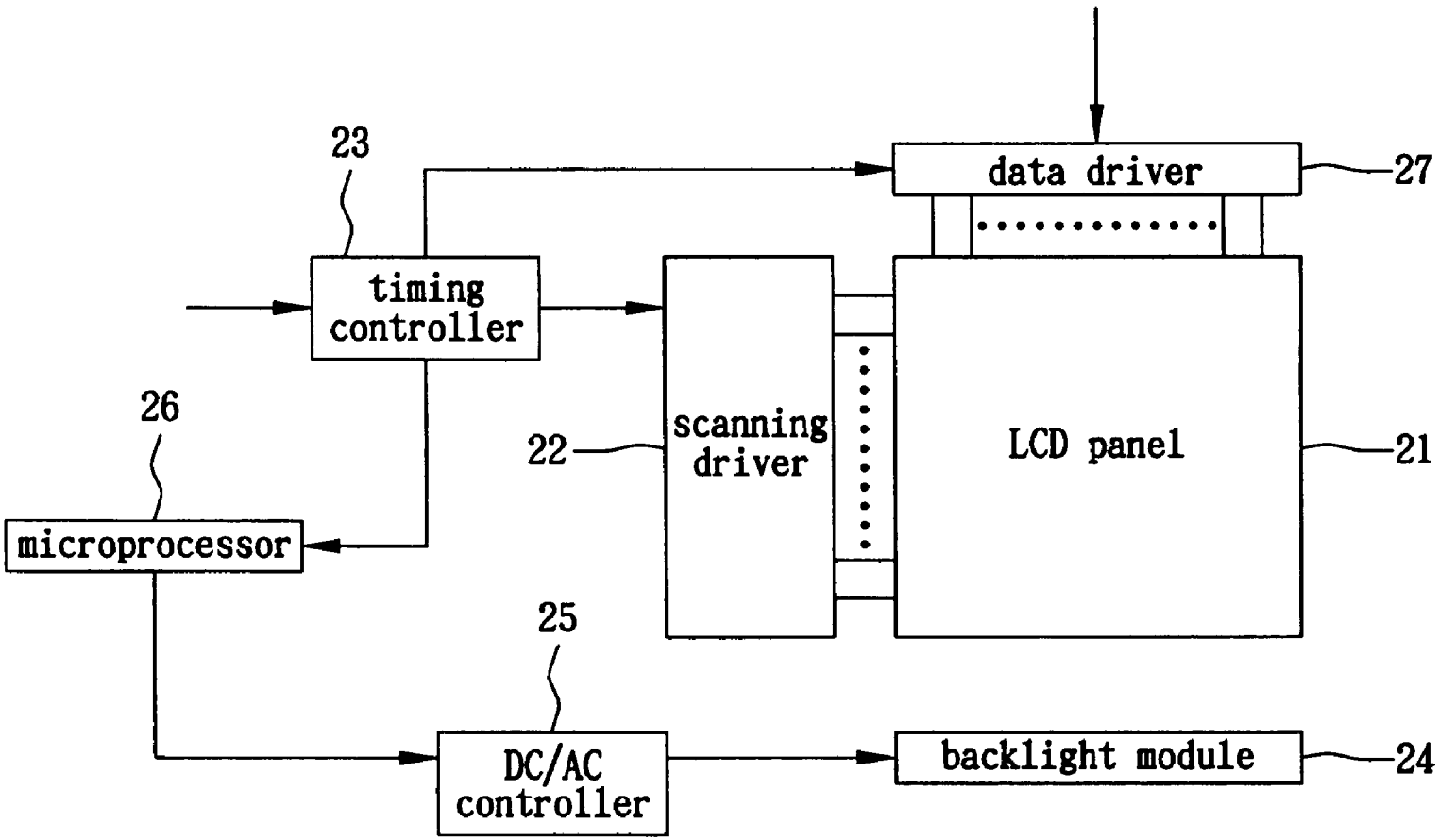
FIG. 2 is a functional block diagram of a liquid crystal display panel in accordance with the present invention.

FIG. 1 is a functional block diagram of a liquid crystal display panel in accordance with the present invention. A timing controller 23 generates timing signals that trigger a scanning driver 22 and a data driver 27 to be active to send the LCD panel 21 various driving signals. Furthermore, a backlight module 24 is placed behind the LCD panel 21 as a light source to highlight the frame displayed by the LCD panel 21 for the viewer to watch. Presently most backlight modules 24 employ a cold cathode fluorescent lamp (CCFL) as a light source, hence a DC/AC converter 25 is necessary to supply AC power to the CCFL.

In comparison with FIG. 1, the output current of the DC/AC converter is controlled by a microprocessor 26 to change the luminous intensity of the backlight modules 24. The microprocessor 26 figures out the brightness distribution of pixels on a frame from the signals of the timing controller 23, and determines how to adjust the output current of the DC/AC converter according to the brightness distribution. Of course, the microprocessor 26 can be integrated into the timing controller 23.

Figure 3:
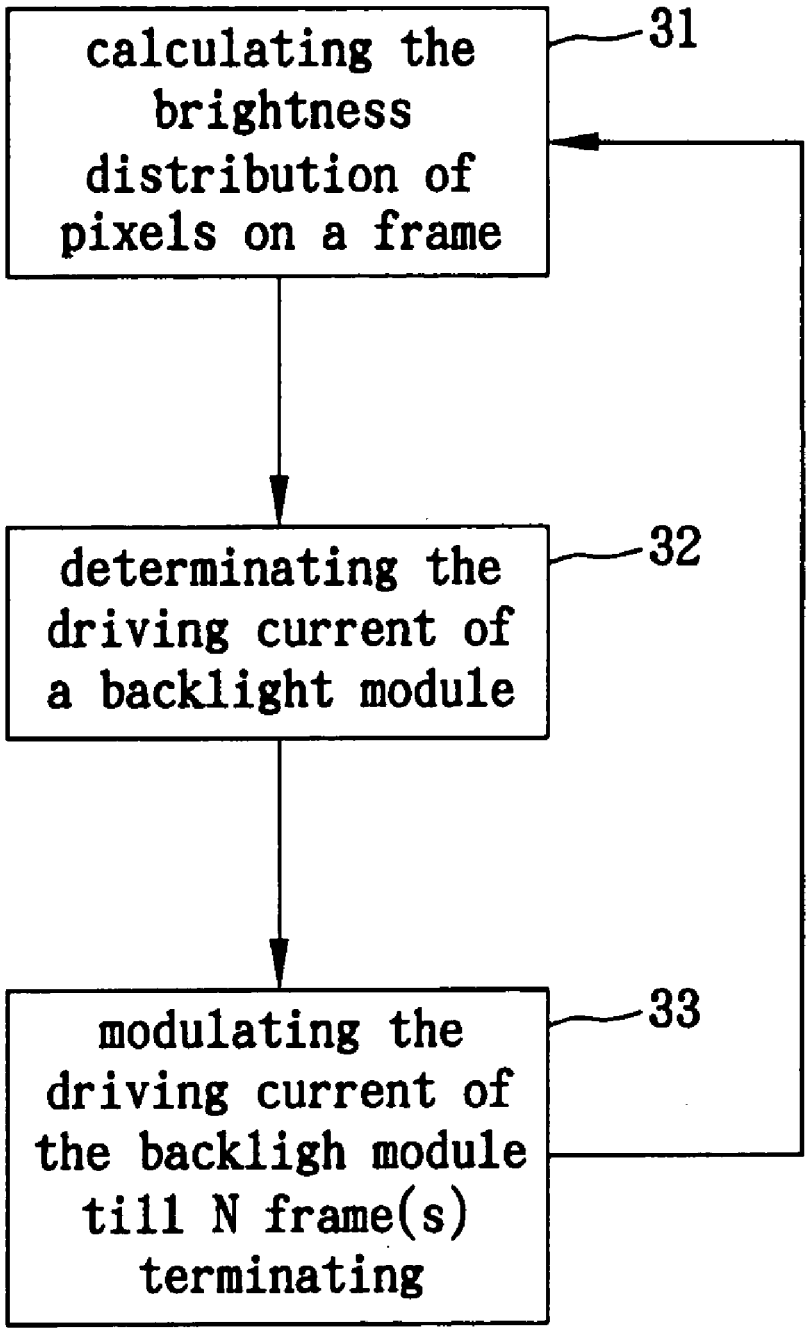
FIG. 3 is a flowchart of the dynamic control method for the driving current of a liquid crystal display panel in accordance with the present invention.

FIG. 3 is a flowchart of the dynamic control method for the driving current of a liquid crystal display panel in accordance with the present invention. As in the step 31 shown in FIG. 3, the brightness distribution of pixels on a frame is figured out from a predetermined formula that defines the index to evaluate the integral brightness of a frame. The formula can be modified according to the size of the frame or other requirements. When the brightness distribution is determined, the driving current of the backlight module is decided, as in the step 32 shown in FIG. 3. The backlight module powered by the driving current change its luminous intensity between every N frame(s) or every N vertical scanning period(s), as in the step 33 shown in FIG. 3, wherein N is a positive integer, preferably from 1 to 60. For the basic principle of the present invention to be comprehended, the aforesaid steps are explained as follows:

Step 1: Calculating the Brightness Distribution of a Frame

An LCD hypothetically has m×n pixels and t-bits data signals, wherein t is a number, 6, 8, 10 or a larger one, m is the number of the data lines, and n is the number of the scanning lines.

Now R/G/B separately represent red, green and blue sub pixels. According to the bit number, we separately have R0-R(t−1) to represent t gradation ranges for the green sub pixel, G0-G(t−1) to represent t gradation ranges for the green sub pixel and B0-B(t−1) to represent t gradation ranges for the blue sub pixel. If the data signal shows t zeros, it represents the darkest gradation level L0; if the data signal shows t ones, it represents the brightest gradation level L$2^t$−1.

$P_{x,y}$ represents the pixel located at the intersection of the X data line and the Y scanning line. Furthermore, $R_NP_{x,y}(0)$-$R_NP_{x,y}(t-1)$, $G_NP_{x,y}(0)$-$G_NP_{x,y}(t-1)$ and $B_NP_{x,y}(0)$-$B_NP_{x,y}(t-1)$ separately represent the gradation ranges of the three sub pixels. A brightness range index $W_{NT}$, the function of all the gradation ranges, is introduced into the embodiment as follows:

$$W_{NT}=W_{NT}[R_NP_{x,y}(T),\ G_NP_{x,y}(T),\ B_NP_{x,y}(T)] \quad \text{(Formula 1)},$$

wherein T is from 0 to t−1.

To be easily comprehended, we assume that the brightness range index $W_{NT}$ is the summation of the gradation ranges, and rewrite Formula 1 as follows:

$$W_{NT} = \sum_{\substack{x=1\\y=1}}^{\substack{x=m\\y=n}} R_N P_{x,y}(T) + G_N P_{x,y}(T) + B_N P_{x,y}(T). \quad \text{(Formula 2)}$$

The brightness range index is now expressed as Formula 2. However, the brightness range index $W_{NT}$ on practical applications is not limited by the expression of this formula, and is dependent on the characteristics or requirements of an LCD panel. The formula can also be expressed as a polynomial of multi-powers terms, trigonometric function terms or logarithmic function terms and other mathematical expressions.

Theoretically, we set various driving currents for the different brightness ranges according to the calculating result of Formula 2. However, a brightness distribution index $S_N$ is further introduced to brighten the frame and assign the corresponding driving current to each range, and it is defined as follows:

$$S_N=S_N(W_{NT}) \quad \text{(Formula 3)}.$$

It is adequate that the coefficient of each the gradation ranges is designated a weighted number to emphasize the difference between the brighter gradation range and darker gradation range.

Therefore, the weighted number is designated by $I_T$, and an inequality $I_{T+1} \geqq I_T > 0$ is satisfied. If the weighted number is equal to zero, it represents that the corresponding brightness range index $W_{NT}$ has no effect on the brightness distribution index $S_N$. That means even though some of the brightness range indices $W_{NT}$, which have no contribution or less contribution for the brightness distribution index $S_N$, is neglected from the formula 3, the clear differences between the brightness ranges will also exist. Furthermore, the calculating operation can be reduced by some steps and sped up, due to the unnecessary need for the brightness range indices.

Before the weighted numbers $I_T$ are really introduced into Formula 3, we have rewritten it as follows:

$$S_N=S_N(I_T,\ W_{NT}) \quad \text{(Formula 4)}.$$

To simply explain this formula, Formula 4 is rewritten with the weighted numbers as follows:

$$S_N = \sum_{T=0}^{T=t-1} I_T W_{NT}. \quad \text{(Formula 5)}$$

Though the brightness distribution index $S_N$ is now expressed as Formula 5, in practical applications it is not limited by the expression of this formula, and is dependent on the characteristics or requirements of an LCD panel. The formula can also be expressed as a polynomial of multi-powers terms, trigonometric function terms or logarithmic function terms and other mathematical expressions.

Step 2: Determining the Driving Current of a Backlight Module

According to the specification of a backlight module, the maximum $A_{max}$ and minimum $A_{min}$ of the driving current are determined. And the higher the value of the brightness distribution index $S_N$, the larger the corresponding driving current A. For the sake of a simple explanation and the reduction of the loading for a microprocessor, the driving current A is chosen from t different values designated by $A_0$, $A_1$, . . . , $A_{t-2}$ and $A_{t-1}$, wherein the sequence of the designations is from the smallest value to the largest value, that is, $A_0$ represents the minimum $A_{min}$ and $A_{t-1}$ represents the maximum $A_{max}$. The minimum $A_{min}$ and the maximum $A_{max}$ vary with the characteristics and requirements of an LCD panel.

In addition, the driving current A is in response to the brightness distribution index $S_N$ that is similar to the driving current A, and needs to define a minimum threshold value $S_L$ and a maximum value $S_H$. The brightness distribution index $S_N$ is also chosen from t different values designated by $S_0$, $S_1$, . . . , $S_{t-2}$, and $S_{t-1}$, wherein $S_0$ is the minimum threshold value $S_L$ and $S_{t-1}$ is the maximum value $S_H$.

Accordingly, the relationship between the brightness distribution index $S_N$ and driving current A is given as follows:

TABLE 1

| | |
|---|---|
| $S_{t-1} \geqq S_N \geqq S_{t-2}$ | $A_{t-1}$ |
| . . . | . . . |
| $S_1 \geqq S_N \geqq S_0$ | $A_1$ |
| $S_N < S_0$ | $A_0$ |

If the microprocessor is powerful, the driving current A can be expressed as a function of the brightness distribution index $S_N$, and satisfies the equations as follows:

$$A = A(S_N); \quad \text{(Formula 6)}$$

$$\frac{d}{dS_N} A(S_N) \geq 0. \quad \text{(Formula 7)}$$

According to Formula 6, the driving current of a backlight module is derived from the brightness distribution of pixels on a frame. Referring to the relationship in Table 1 and the aforesaid description, Formula 6 is the specific example of a step function. The determining method of the present invention for the driving current is not only limited by the relationship in Table 1. Formula 7 represents the derivative relationship of the driving current A and the brightness distribution $S_N$.

Step 3: Modulating the Driving Current of a Backlight Module and Remaining N Frame(s)

No specific formula is given during the current step, and the driving current determined by the previous step is input into the backlight module till N frame(s). Before the (N+1)th frame appears, the brightness range indices $W_{NT}$ of the previous N frames are calculated and the corresponding distribution index is also calculated from these indices according to the disclosure of Step 2. The aforesaid steps can be reiterated to fulfill the method of the present invention.

For further explaining the theorem of the aforesaid dynamic adjustment, we have three embodiments of the three steps disclosed as follows:

The First Embodiment

The present embodiment employs an LCD panel with 6-bits data signals to explain how to actually take advantage of Formula 2. The LCD panel comprises a plurality of pixels having R/G/B sub pixels. For example, the frame of a XGA LCD panel has demands for 768×1,024×3 gradation data.

R0-R5 respectively represents 6 gradation ranges, wherein if the data signal shows 000000, it represents the darkest gradation level L0, and if the data signal shows 111111, it represents the brightest gradation level L63. In the same way, G0-G6 and B0-B5 respectively represents the 6 gradation ranges of a green sub pixel and a blue sub pixel.

$P_{x,y}$ represents the pixel located at the intersection of the X data line and the Y scanning line. $RP_{x,y}(\mathbf{0})$ represents the gradation range R0 of the red sub pixels. In the same way, $GP_{x,y}(\mathbf{5})$ and $BP_{x,y}(\mathbf{5})$ respectively represent the brightest gradation ranges G5 for a green sub pixel and B5 for a blue sub pixel. WA, WB, WC, WD, WE and WF respectively represent the brightness ranges indices of the corresponding gradation ranges as follows:

$$WA = \sum_{\substack{x=1\\y=1}}^{\substack{x=1024\\y=768}} RP_{x,y}(5) + GP_{x,y}(5) + BP_{x,y}(5)$$

$$WB = \sum_{\substack{x=1\\y=1}}^{\substack{x=1024\\y=768}} RP_{x,y}(4) + GP_{x,y}(4) + BP_{x,y}(4)$$

$$WC = \sum_{\substack{x=1\\y=1}}^{\substack{x=1024\\y=768}} RP_{x,y}(3) + GP_{x,y}(3) + BP_{x,y}(3)$$

$$WD = \sum_{\substack{x=1\\y=1}}^{\substack{x=1024\\y=768}} RP_{x,y}(2) + GP_{x,y}(2) + BP_{x,y}(2)$$

-continued $$WE = \sum_{\substack{x=1\\y=1}}^{\substack{x=1024\\y=768}} RP_{x,y}(1) + GP_{x,y}(1) + BP_{x,y}(1)$$

$$WF = \sum_{\substack{x=1\\y=1}}^{\substack{x=1024\\y=768}} RP_{x,y}(0) + GP_{x,y}(0) + BP_{x,y}(0).$$

Weighted numbers are given as that $I_5=2$, $I_4=1$, $I_3=0.5$ and $I_2=I_1=I_0=0$, and S represent the brightness distribution index when N is equal to 1. Furthermore, the driving current of the backlight module can be determined by mathematical calculations expressed as follows:

(1) Let $S=2\times WA+WB+0.5\times WC$ and $S_0=1000$. When $S<S_0$ is satisfied, the driving current $A_0$ is given as 2 micro amperes. That is, the luminous intensity of the backlight module is reduced to the lowest level to match up with a frame showing a darker imagine.

(2) Let $S=2\times WA+WB+0.5\times WC$ and $S_1=0.05\times 1024\times 768\times 3$. When $S_0<S<S_1$ is satisfied, the driving current $A_1$ is given as 2.8 (=2+(6−2)×0.2) micro amperes, wherein the coefficient 0.05 represents that about 5% pixels have gradation levels higher than L31.

(3) Let $S=2\times WA+WB+0.5\times WC$ and $S_2=0.1\times 1024\times 768\times 3$. When $S_1<S<S_2$ is satisfied, the driving current $A_2$ is given as 3.6 (=2+(6−2)×0.4) micro amperes, wherein the coefficient 0.10 represents that about 10% pixels have gradation levels higher than L31.

(4) Let $S=2\times WA+WB+0.5\times WC$ and $S_3=0.15\times 1024\times 768\times 3$. When $S_2<S<S_3$ is satisfied, the driving current $A_3$ is given as 4.4 (=2+(6−2)×0.6) micro amperes, wherein the coefficient 0.15 represents that about 15% pixels have gradation levels higher than L31.

(5) Let $S=2\times WA+WB+0.5\times WC$ and $S_4=0.20\times 1024\times 768\times 3$. When $S_3<S<S_4$ is satisfied, the driving current $A_4$ is given as 5.2 (=2+(6−2)×0.8) micro amperes, wherein the coefficient 0.20 represents that about 20% pixels have gradation levels higher than L31.

(6) Let $S=2\times WA+WB+0.5\times WC$ and $S_5=0.25\times 1024\times 768\times 3$. When $S_4<S<S_5$ is satisfied, the driving current $A_5$ is given as 6 (=2+(6−2)×1) micro amperes, wherein the coefficient 0.25 represents that about 25% pixels have gradation levels higher than L31.

The Second Embodiment

Except one vertical scanning period can be designated as an modulating period for the luminous intensity of a backlight module, several vertical scanning periods can also be designated as an modulating period for that. $WA_N$ is the summation of all the values WA during consecutive N vertical scanning periods. In the same way, $WB_N$ and $WC_N$ are also derived.

After N (N=2-60) vertical scanning periods ending, the driving current of the backlight module can be determined by mathematical calculations expressed as follows:

(1) Let $S_N=2\times WA_N+WB_N+0.5\times WC_N$ and $S_0=1000\times N$. When $S_N<S_0$ is satisfied, the driving current $A_0$ is given as 2 micro amperes. That is, the luminous intensity of the backlight module is reduced to the lowest level to match up with a frame showing a darker imagine.

(2) Let $S_N=2\times WA_N+WB_N+0.5\times WC_N$ and $S_1=0.05\times 1024\times 768\times 3$. When $S_0<S_N<S_1$ is satisfied, the driving current $A_1$ is given as 2.8 (=2+(6−2)×0.2) micro amperes, wherein the coefficient 0.05 represents that about 5% pixels have gradation levels higher than L31.

(3) Let $S_N=2\times WA_N+WB_N+0.5\times WC_N$ and $S_2=0.1\times 1024\times 768\times 3$. When $S_1<S_N<S_2$ is satisfied, the driving current $A_2$ is given as 3.6 (=2+(6−2)×0.4) micro amperes, wherein the coefficient 0.10 represents that about 10% pixels have gradation levels higher than L31.

(4) Let $S_N=2\times WA_N+WB_N+0.5\times WC_N$ and $S_3=0.15\times 1024\times 768\times 3$. When $S_2<S_N<S_3$ is satisfied, the driving current $A_3$ is given as 4.4 (=2+(6−2)×0.6) micro amperes, wherein the coefficient 0.15 represents that about 15% pixels have gradation levels higher than L31.

(5) Let $S_N=2\times WA_N+WB_N+0.5\times WC_N$ and $S_4=0.20\times 1024\times 768\times 3$. When $S_3<S_N<S_4$ is satisfied, the driving current $A_4$ is given as 5.2 (=2+(6−2)×0.8) micro amperes, wherein the coefficient 0.20 represents that about 20% pixels have gradation levels higher than L31.

(6) Let $S_N=2\times WA_N+WB_N+0.5\times WC_N$ and $S_5=0.25\times 1024\times 768\times 3$. When $S_4<S_N<S_5$ is satisfied, the driving current $A_5$ is given as 6 (=2+(6−2)×1) micro amperes, wherein the coefficient 0.25 represents that about 25% pixels have gradation levels higher than L31.

The Third Embodiment

Though the brightness distribution index is now expressed as Formula 5, in practical applications it is not limited by the expression of this formula, and is dependent on the characteristics or requirements of an LCD panel. The formula also can be expressed as a polynomial of multi-powers terms, trigonometric function terms or logarithmic function terms and other mathematical expressions. The embodiment employs multi-powers terms to replace terms with constant coefficients and ignores the effects of terms WD, WE and WF upon $S_N$. The driving current of the backlight module can be determined by mathematical calculations expressed as follows:

(1) Let $S_N=WA^2+WB+WC^{0.5}$ and $S_0=1000$. When $S_N<S_0$ is satisfied, the driving current $A_0$ is given as 2 micro amperes. That is, the luminous intensity of the backlight module is reduced to the lowest level to match up with a frame showing a darker imagine.

(2) Let $S_N=2\times WA^2+WB+0.5\times WC^{0.5}$ and $S_1=0.05\times 1024\times 768\times 3$. When $S_0<S_N<S_1$ is satisfied, the driving current $A_1$ is given as 2.8 (=2+(6−2)×0.2) micro amperes, wherein the coefficient 0.05 represents that about 5% pixels have gradation levels higher than L31.

(3) Let $S_N=2\times WA^2+WB+0.5\times WC^{0.5}$ and $S_2=0.1\times 1024\times 768\times 3$. When $S_1<S_N<S_2$ is satisfied, the driving current $A_2$ is given as 3.6 (=2+(6−2)×0.4) micro amperes, wherein the coefficient 0.10 represents that about 10% pixels have gradation levels higher than L31.

(4) Let $S_N=2\times WA^2+WB+0.5\times WC^{0.5}$ and $S_3=0.15\times 1024\times 768\times 3$. When $S_2<S_N<S_3$ is satisfied, the driving current $A_3$ is given as 4.4 (=2+(6−2)×0.6) micro amperes, wherein the coefficient 0.15 represents that about 15% pixels have gradation levels higher than L31.

(5) Let $S_N=2\times WA^2+WB+0.5\times WC^{0.5}$ and $S_4=0.20\times 1024\times 768\times 3$. When $S_3<S_N<S_4$ is satisfied, the driving current $A_4$ is given as 5.2 (=2+(6−2)×0.8) micro amperes, wherein the coefficient 0.20 represents that about 20% pixels have gradation levels higher than L31.

(6) Let $S_N=2\times WA^2+WB+0.5\times WC^{0.5}$ and $S_5=0.25\times 1024\times 768\times 3$. When $S_4<S_N<S_5$ is satisfied, the driving current $A_5$ is given as 6 (=2+(6−2)×1) micro amperes, wherein the coefficient 0.25 represents that about 25% pixels have gradation levels higher than L31.

The present invention can be applied to LCD panels with various types, such as VGA (640×480), SVGA (800×600), XGA (1024×768), SXGA (1280×1024), UXGA (1600×1200) and QXGA (2048×1536).

The driving currents and the corresponding brightness distribution ranges are the same in the aforesaid embodiments, and these are suitable for an XGA LCD panel with 6-bits data signals. Practically, these are dependent on the characteristics or requirements of the LCD panel.

The above-described embodiments of the present invention are intended to be illustrative only. Numerous alternative embodiments may be devised by persons skilled in the art without departing from the scope of the following claims.

What is claimed is:

1. A method for dynamically modulating driving current applied to a backlight module, comprising the steps of:

calculating the brightness distribution of a pixel on a frame;

determining the value of the driving current of the backlight module according to the calculated brightness distribution; and applying the determined driving current to the backlight module during at least one vertical scanning period;

wherein the brightness distribution is calculated according to the percentage of high brightness pixels whose gradation levels are respectively larger than a default level, and the driving current is adjusted in terms of the percentage.

2. The method for dynamically modulating driving current applied to a backlight module of claim 1, wherein if the brightness distribution is concentrated in high brightness, the value of the driving current is increased so as to raise the luminous intensity of the backlight module.

3. The method for dynamically modulating driving current applied to a backlight module of claim 1, wherein if the brightness distribution is concentrated in low brightness, the value of the driving current is decreased so as to reduce the luminous intensity of the backlight module.

4. The method for dynamically modulating driving current applied to a backlight module of claim 1, wherein the driving current of the backlight module begins to be modulated every one to sixty vertical scanning periods.

5. The method for dynamically modulating driving current applied to a backlight module of claim 1, wherein the default level is decimal level 31 when the gradation level is represented as 6-bit binary data.

6. A method for dynamically modulating driving current applied to a backlight module, comprising the steps of:

calculating the brightness distribution of a pixel on a frame;

designating various gradation ranges to represent corresponding brightness of red, green and blue sub pixels on the frame;

counting the amount of the sub pixels pertaining to each of the gradation ranges to have brightness range indices;

calculating a bright destruction index for the frame according to the brightness range indices;

determining the value of the driving current of the backlight module according to the calculated brightness distribution; and applying the determined driving current to the backlight module during at least one vertical scanning period;

wherein the brightness distribution index is expressed as an equation of the brightness ranges indices multiplied by corresponding weighted numbers, the weighted numbers are generated based on the gradation ranges, and each of the weighted numbers is not less than 0.

7. The method for dynamically modulating driving current applied to a backlight module of claim 6, wherein the brightness range indices can be expressed as a function of the amount of the sub pixels pertaining to each of the gradation ranges with a polynomial of multi-power terms, trigonometric function terms or logarithmic function terms, and the function is dependent on requirements of the backlight module.

8. The method for dynamically modulating driving current applied to a backlight module of claim 6, wherein the brightness distribution index can be expressed as a function of the brightness range indices with a polynomial of multi-power terms, trigonometric function terms or logarithmic function terms, and the function is dependent on the requirements of the backlight module.

9. The method for dynamically modulating driving current applied to a backlight module of claim 6, wherein the driving current of the backlight module is determined by the steps of:

defining maximum and minimum values of the driving current and a plurality of intermediate values between the maximum and minimum values; and designating the value of each driving current sequentially in accordance with the brightness distribution index.

10. The method for dynamically modulating driving current applied to a backlight module of claim 6, wherein maximum and minimum values appearing on the driving current are dependent on the requirements of the backlight module.

* * * * *